US006470627B2

(12) United States Patent
Fukuo

(10) Patent No.: US 6,470,627 B2
(45) Date of Patent: Oct. 29, 2002

(54) GUIDING STRUCTURE FOR MOVING MEMBER

(75) Inventor: Michihiro Fukuo, Tokyo (JP)

(73) Assignee: Nifco Inc., Yokohama (JP)

( * ) Notice: Subject to any disclaimer, the term of this patent is extended or adjusted under 35 U.S.C. 154(b) by 0 days.

(21) Appl. No.: 09/840,076

(22) Filed: Apr. 24, 2001

(65) Prior Publication Data

US 2002/0029523 A1 Mar. 14, 2002

(30) Foreign Application Priority Data

May 1, 2000 (JP) ..... 2000-132178

(51) Int. Cl.[7] ..... E05D 15/58
(52) U.S. Cl. ..... 49/260; 224/275
(58) Field of Search ..... 49/260; 224/539, 224/275, 280, 926; 220/260, 332

(56) References Cited

U.S. PATENT DOCUMENTS 4,091,958 A * 5/1978 Zemke ..... 220/291
5,520,313 A * 5/1996 Toshihide ..... 224/539
5,620,122 A 4/1997 Tanaka
5,718,405 A * 2/1998 Adachi ..... 248/311.2
6,161,336 A * 12/2000 Ziv-Az ..... 49/260

FOREIGN PATENT DOCUMENTS

| | | |
|---|---|---|
| EP | 0 097 876 | 1/1984 |
| GB | 1 236 884 | 6/1971 |
| GB | 2 055 705 | 3/1981 |

* cited by examiner

*Primary Examiner*—David M. Purol
(74) *Attorney, Agent, or Firm*—Kaneska & Takeuchi

(57) ABSTRACT

A guiding structure for a moving member includes a cam groove provided in a fixed member, a shaft inserted into the cam groove and attached to a moving member, and a collar provided on the shaft to be rotated around the shaft while slidably contacting groove walls of the cam groove. Thus, without applying a lubricant to the shaft and the cam groove, the shaft can be guided with less frictional resistance with respect to the cam groove.

11 Claims, 7 Drawing Sheets

GUIDING STRUCTURE FOR MOVING MEMBER

BACKGROUND OF THE INVENTION AND RELATED ART STATEMENT

The invention relates to a guiding structure for regularly moving a moving member movably attached to a fixed member, more specifically, improvement of a guiding structure for regularly moving a moving member by guiding a shaft provided at one of a fixed member and a moving member along a cam groove provided at the other of the fixed member and the moving member to thereby move the moving member regularly.

There has been proposed a guiding structure, wherein a shaft provided at a moving member, such as a lid, for openably closing an opening of a fixed member, such as a housing box, is guided along a cam groove disposed on the housing box, to thereby regularly move the moving member. For example, refer to Japanese Patent Publication (KOKAI) No. 8-156698.

However, in such a guiding structure, heretofore, in order to smoothly move the moving member, in other words, in order to reduce frictional resistance between the shaft and the cam groove when the moving member is moved, and to prevent noises when the shaft is guided in the cam groove, it is indispensable to provide a large amount of lubricant, such as grease, around the shafts.

Thus, when a product using such a guiding structure is manufactured, there are disadvantages such that a step for applying the lubricant is required, and also, the lubricant to be applied adheres to hands of a worker who carries out the final assembling work of the product to thereby make the work difficult.

Accordingly, the present invention has been made in view of the foregoing problems, and an object of the invention is to provide a guiding structure for a moving member, wherein without applying a lubricant to a shaft provided to one of a fixed member and the moving member guided along a cam groove formed at the other of the fixed member and the moving member, the shaft can be guided with less frictional resistance with respect to the cam groove to thereby smoothly move the moving member.

Further objects and advantages of the invention will be apparent from the following description of the invention.

SUMMARY OF THE INVENTION

To achieve the above objects, according to a first aspect of the invention, a guiding structure for a moving member includes a slit-shape cam groove provided in one of a fixed member and a moving member; a shaft attached to the other of the fixed member and the moving member and inserted into the cam groove; and a collar provided on the shaft to slidably contact groove walls of the cam groove so as to rotate around the shaft.

According to the structure as described above, as the moving member is moved, the moving member can be regularly moved such that the shaft is guided along the cam groove through the collar. Also, resistance caused by the shaft guided along the cam groove can be reduced by the rotation of the collar slidably contacting the groove walls of the cam groove to thereby smoothly move the moving member.

According to a second aspect of the invention, the guiding structure for the moving member of the first aspect further includes a flange provided on an outer peripheral portion of the collar to be caught by one of groove edge portions of the cam groove.

According to the structure as described above, the collar can be stably positioned in the cam groove.

According to a third aspect of the present invention, the guiding structure for the moving member according to the first aspect further includes a hollow or dent portion provided in one of an outer peripheral portion of the shaft and an inner peripheral portion of the collar so as to fit with a projection provided on the other of the outer peripheral portion of the shaft and the inner peripheral portion of the collar, so that the collar is rotated around the shaft.

With this structure, the collar can be stably positioned in the cam groove in a rotatable state.

According to a fourth aspect of the invention, the guiding structure for the moving member of the second aspect further includes a protruded portion on one side of the edges of the cam groove, and the flange of the collar contacts a projecting end of the protruded portion.

According to the structure as described above, the flange of the collar does not entirely contact an outer surface of the cam groove provided at the groove edge portion of the cam groove, so that frictional resistance between the collar and the fixed member where the cam groove is formed is not increased extremely.

According to a fifth aspect of the invention, in the guiding member for the moving member of the first, second, third or fourth aspect, the collar and at least a portion of the cam groove the collar slidably contacts are made of a plastic material.

In case plural members made of the plastic material are used together, even if a special surface treatment is not applied to their slidingly contacting surfaces, a frictional resistance caused by the sliding contact of the members made of the plastic material becomes lower than that caused by the sliding contact of a member made of the plastic material and a member made of a metal material. Thus, according to the structure, even if the collar slidably contacting the groove walls of the cam groove is not rotated around the shaft by the sliding contact, an outer peripheral surface of the collar is facilitated to slide along the groove walls, so that the moving member can be smoothly moved at all times.

According to a sixth aspect of the invention, in the guiding structure for the moving member of the first, second, third, fourth or fifth aspect, the fixed member is a housing box having an opening, and the moving member is a lid movable from a position for closing the opening of the housing box to a position for opening the same.

According to the structure as described above, the lid for closing the opening of the housing box can be smoothly moved from the closing position to an opening position, so that various housing members can be properly formed.

According to a seventh aspect of the invention, the guiding structure for the moving member of the sixth aspect of the invention is further structured such that a cam groove is formed on a side wall of the housing box; one end of the shaft is provided with a head portion so that the shaft is inserted into the cam groove through a shaft inserting hole disposed on the lid from the other end thereof to a position where the head portion is caught by the inserting hole; and a preventing member for preventing the shaft from being extracted or disengaged from the cam groove is attached to the other end of the shaft.

According to the structure as described above, each shaft with the collar is inserted into the cam groove such that the collar is positioned in the cam groove through the inserting hole provided in the lid, and then, the preventing member is attached to the other end of the shaft, so that the lid can be easily attached to the housing box in a state where the lid can be regularly moved along the cam groove.

DETAILED DESCRIPTION OF THE PREFERRED EMBODIMENTS

Hereunder, with reference to FIGS. 1 to 11, embodiments of a guiding structure for a moving member according to the invention are explained.

Figure 1:
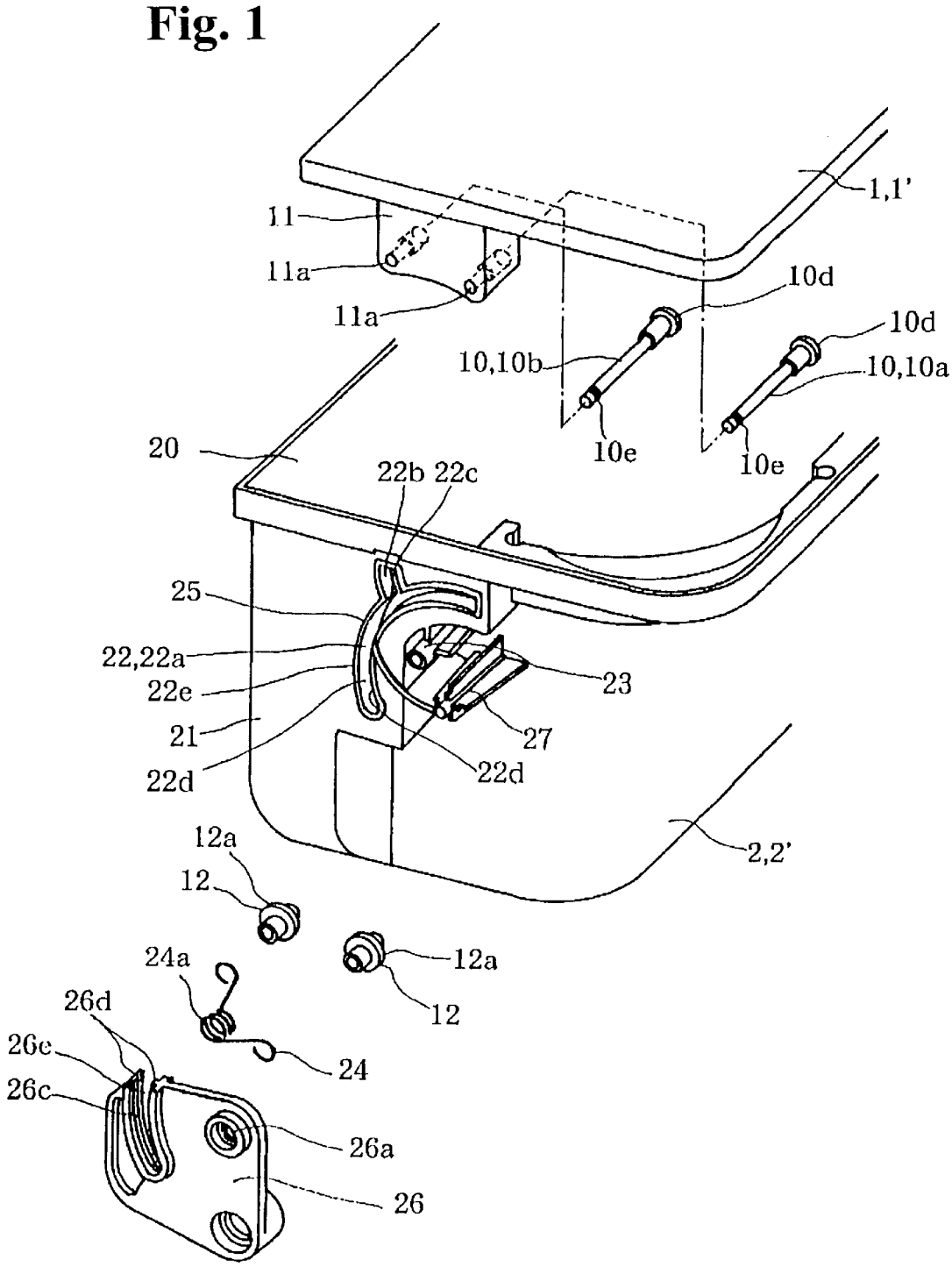
FIG. 1 is an exploded perspective view of essential parts of a housing member of an embodiment according to the present invention.
Figure 2:
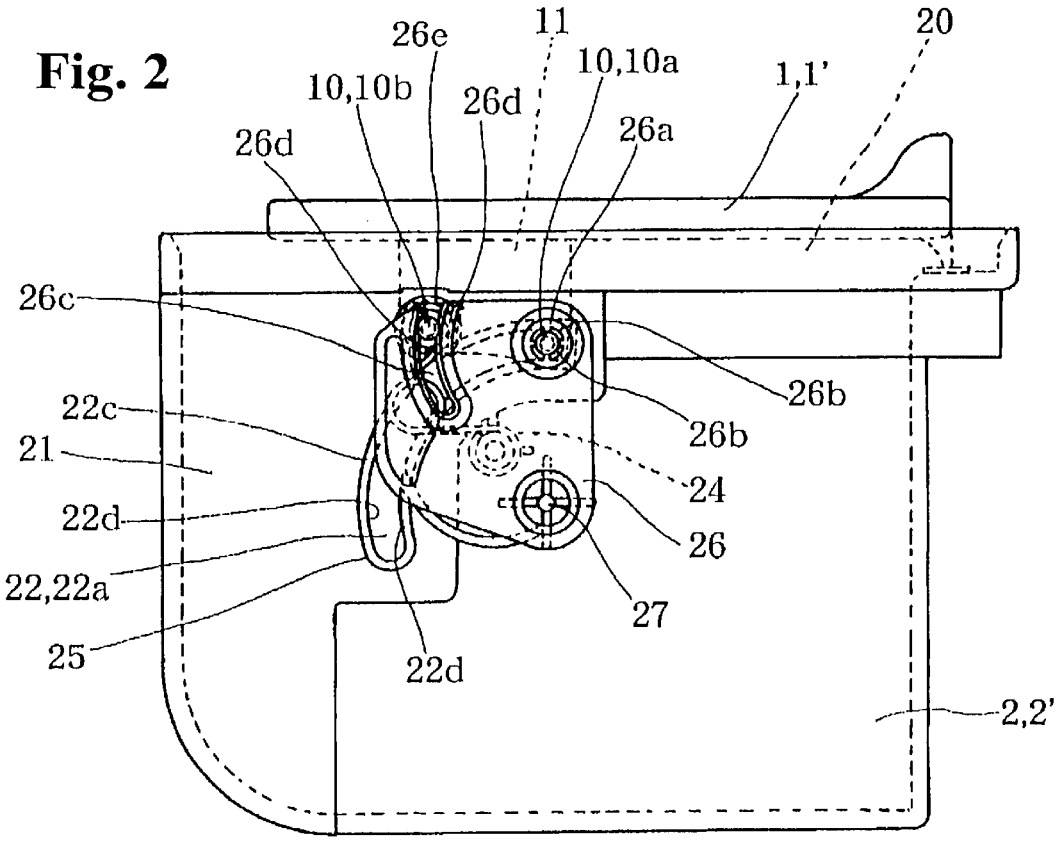
FIG. 2 is a side view of the housing member shown in FIG. 1.
Figure 3:
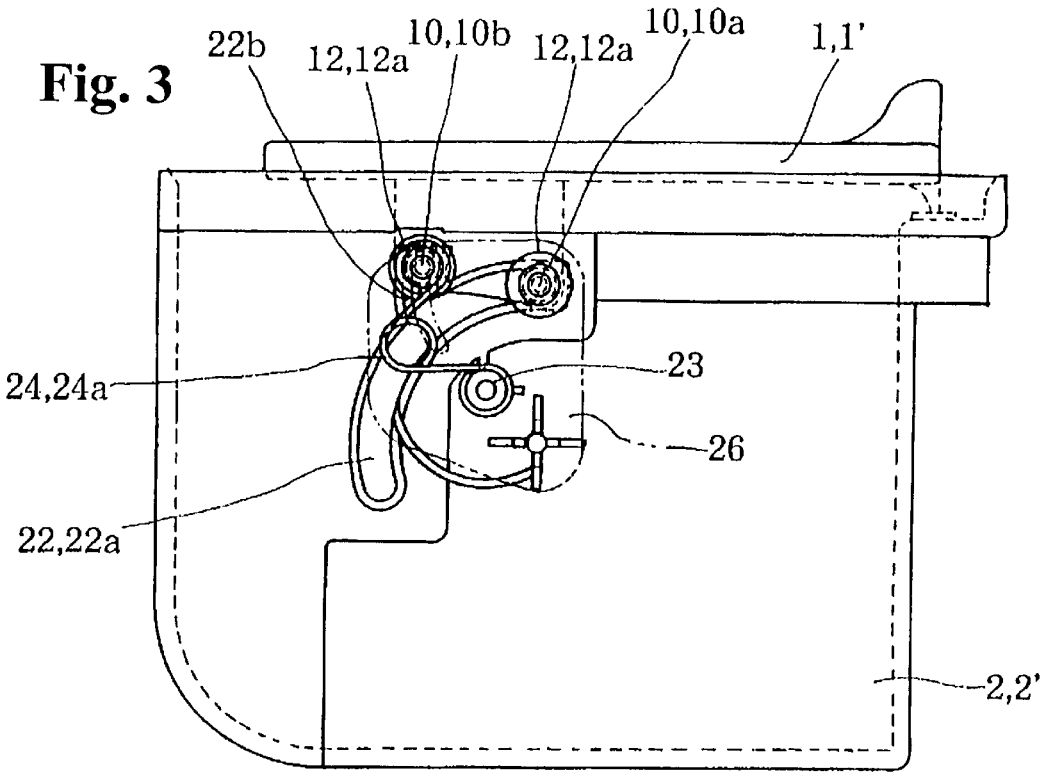
FIG. 3 is a side view of the same.
Figure 4:
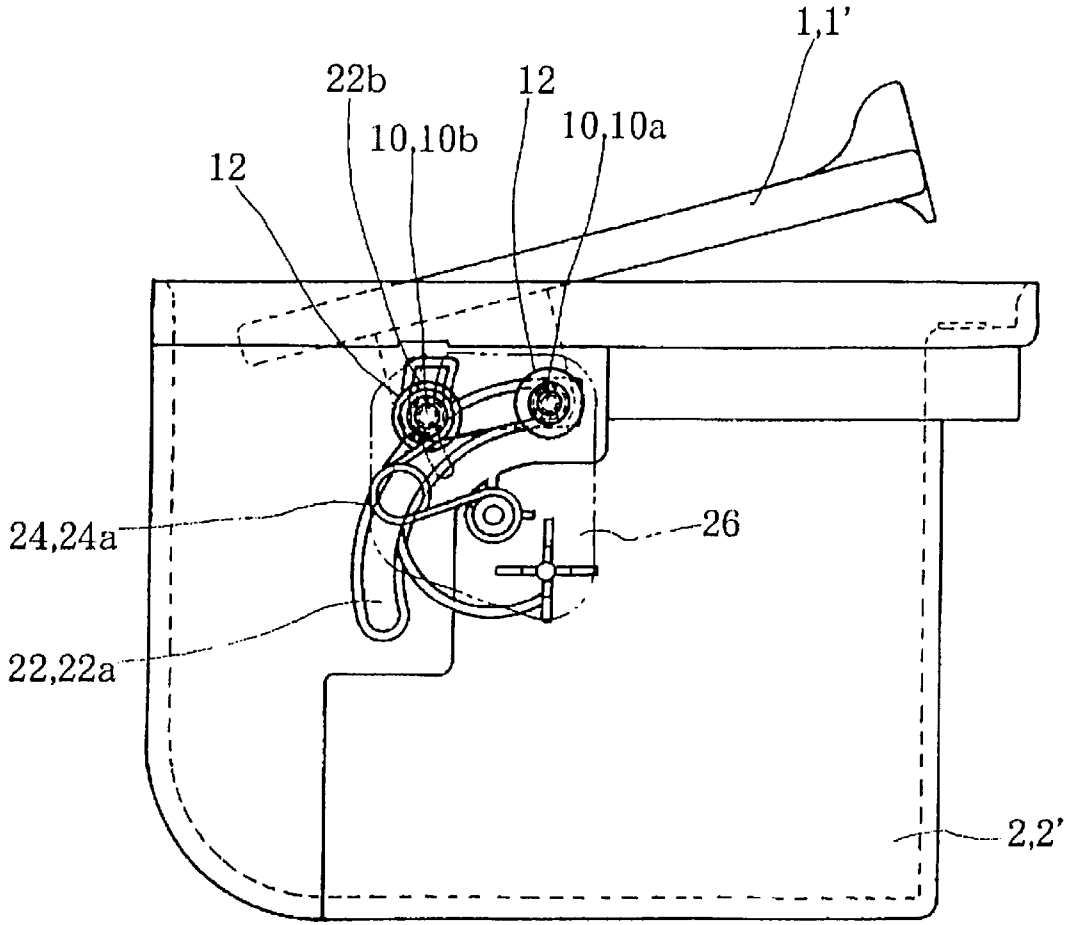
FIG. 4 is a side view of the same.
Figure 5:
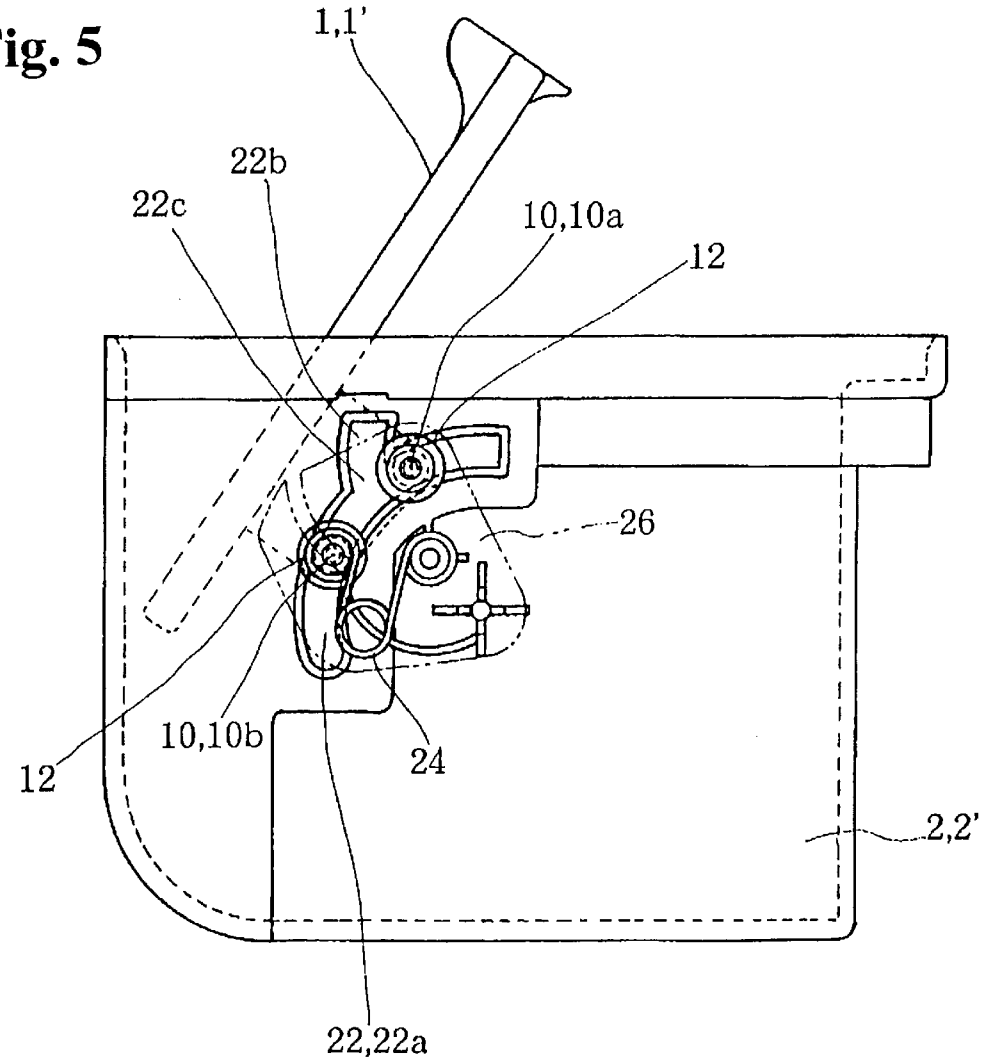
FIG. 5 is a side view of the same.
Figure 6:
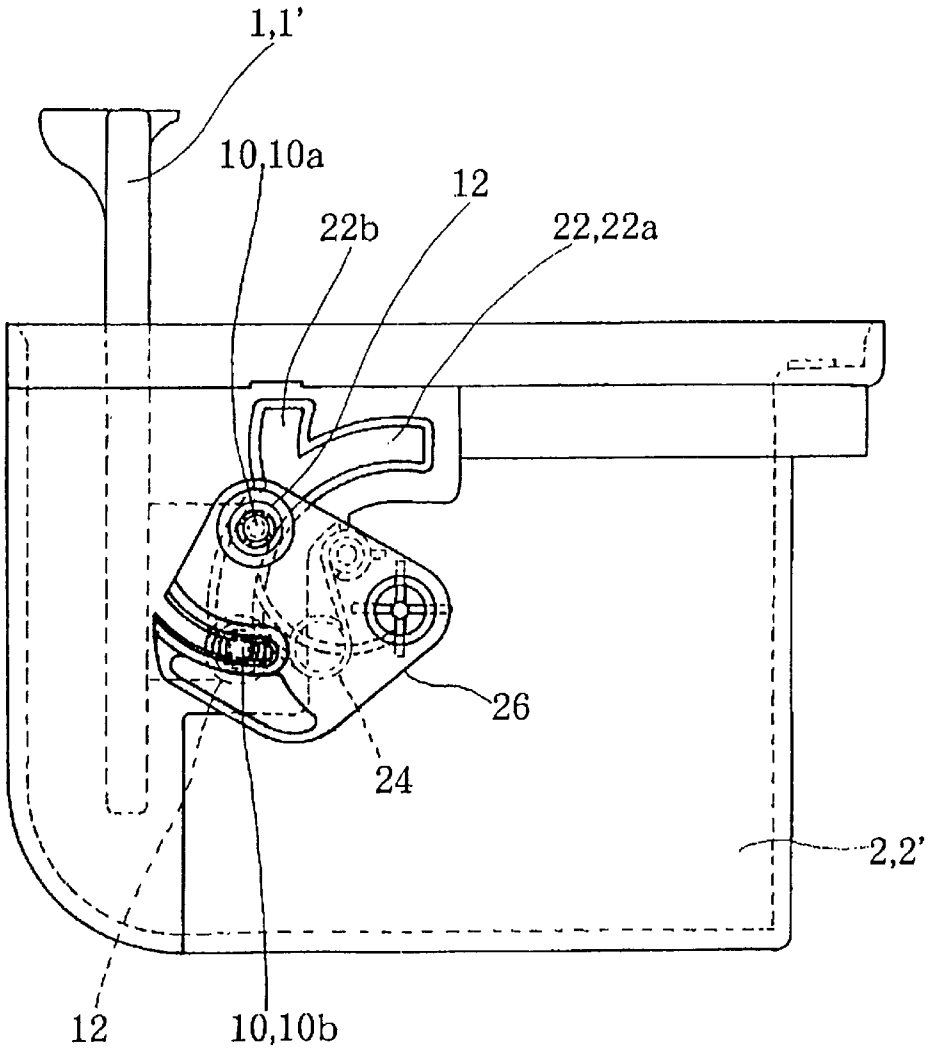
FIG. 6 is a side view of the same.
Figure 7:
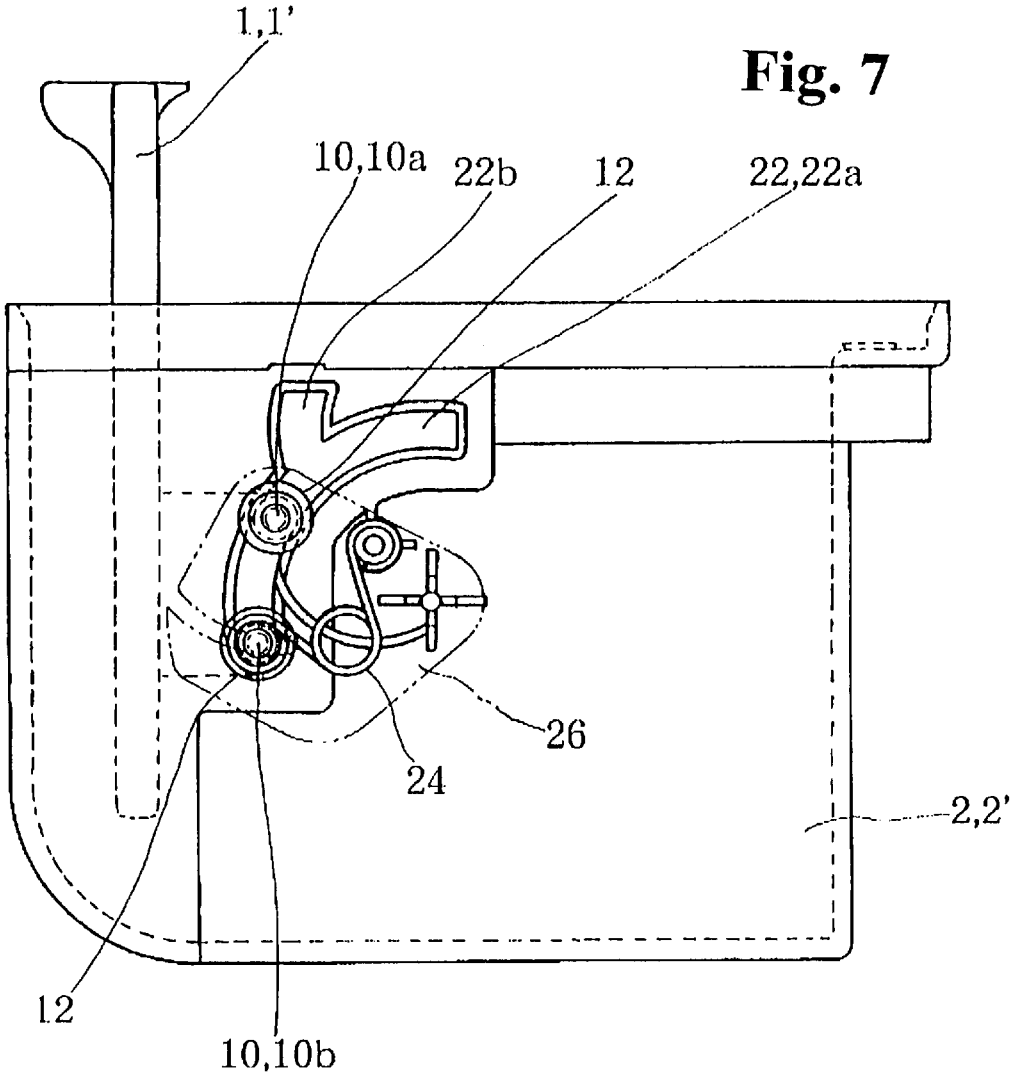
FIG. 7 is a side view of the same.
Figure 8:
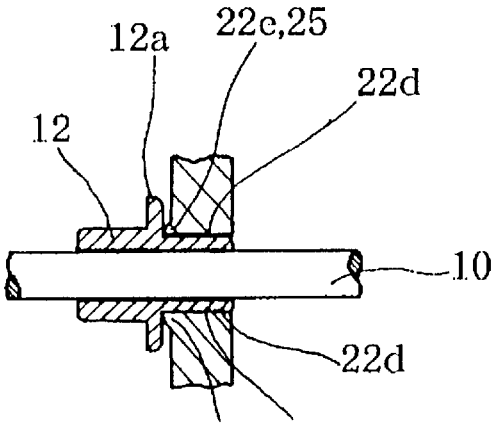
FIG. 8 is a sectional view of an essential part of the housing member shown in FIG. 1.
Figure 9:
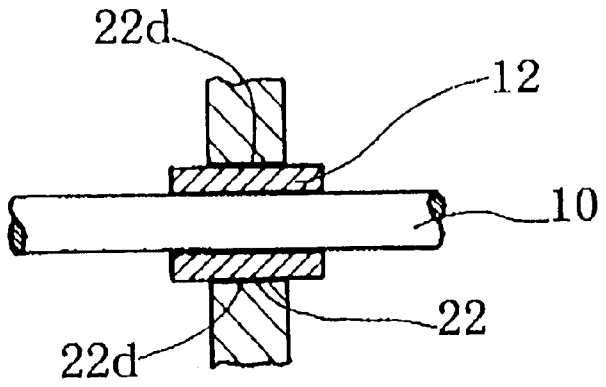
FIG. 9 is a sectional view of an essential part showing a modified example of the portion shown in FIG. 8.
Figure 10:
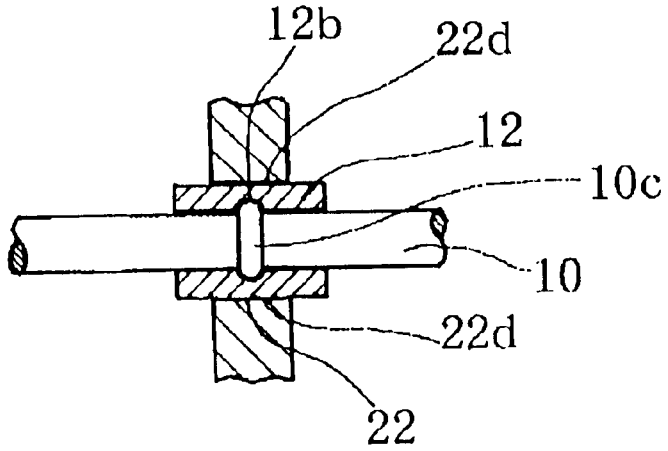
FIG. 10 is a sectional view of an essential part showing another modified example of the portion shown in FIG. 8.
Figure 11:
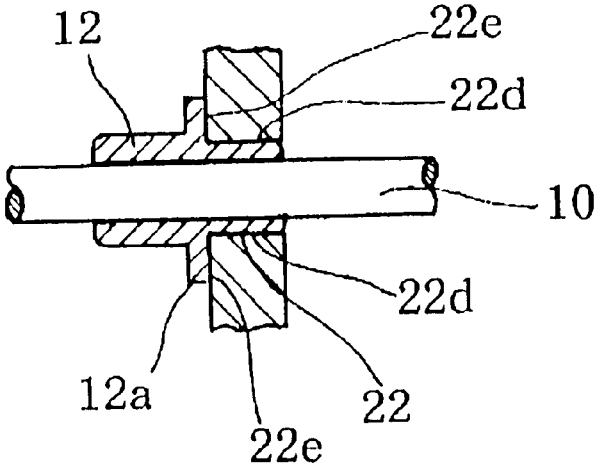
FIG. 11 is a sectional view of an essential part showing a still further modified example of the portion shown in FIG. 8.

Incidentally, FIG. 1 is an exploded perspective view of various parts for facilitating understanding of an essential constitution of a housing member constituted according to the guiding structure of the invention. FIGS. 2 to 7 are structural drawings for a portion to which the guiding structure of the housing member is applied, viewed from a side thereof, wherein FIGS. 2 and 3 show a state where a lid 1' as a moving member 1 is positioned horizontally; FIG. 6 and 7 show a state where the lid 1' is positioned upright; and FIGS. 4 and 5 show a state where the lid 1' is moving from the upright position to the horizontal position or from the horizontal position to the upright position. An opening operation of the lid 1' proceeds in the order of FIGS. 3, 4, 5 and 7, and its closing operation proceeds in a reverse order thereof. By the way, a rotation plate 26 rotating in association with the movement of the lid 1' is shown by phantom lines in FIGS. 3, 4, 5 and 7. FIG. 8 is a sectional view for facilitating understanding of a structure including a cam groove 22 regularly moving the lid 1', a shaft 10 inserted into the cam groove 22 and a collar 12 rotatably provided on the shaft 10 and slidably contacting a groove wall 22*d* of the cam groove 22. FIGS. 9 to 11 how modified structures of the collar 12, respectively.

The guiding structure for the moving member 1 of the embodiment is applied for regularly and movably attaching the moving member 1 to a fixed member 2.

As the fixed member 2, typically, there can be mentioned a housing box having an opening and various fixed members provided with drawer members. Also, as the moving member 1, there can be mentioned a lid attached to the housing box to be movable from a position for closing the opening of the housing box to a position for opening the same, and a drawer member provided at the fixed member to be pulled out therefrom.

A housing member shown in FIGS. 1 to 7 is an example to which the above-mentioned guiding structure is applied.

The housing member includes a housing box 2', i.e. fixed member 2, provided with an opening 20 on an upper surface thereof, and a lid 1', i.e. moving member 1, in a shape of a plate attached to the housing box 2' movable from a horizontal position for closing the opening 20 of the housing box 2' to an upright position.

The housing box 2' includes a cam groove 22 in a slit shape in a side wall 21 thereof. The lid 1' is provided with shafts 10 in a shape of a round bar to be inserted into the cam groove 22 from an inner side of the housing box 2', on a side facing the side wall 21 to which the cam groove 22 is provided. Two shafts 10 are attached to a projection 11 disposed on an inner surface side of the lid 1' with a space therebetween in a front-and-rear direction of the lid 1'. In the present embodiment, the two shafts 10 of the lid 1' are inserted into the cam groove 22, and the two shafts 10 are guided and supported by the cam groove 22 to thereby regularly move the lid 1'.

Specifically, the cam groove 22 includes a primary cam groove 22*a* formed such that when the lid 1' is located at the horizontal position for closing the opening 20, a side where a front end of the lid 1' is positioned becomes a curved inner side; and a secondary cam groove 22*b* branched from the primary cam groove 22*a* and extending upwardly therefrom to receive and support one of the two shafts 10 located on a rear end side of the lid 1' at the position where the lid 1' is located on a horizontal position (hereinafter one of the shafts 10 is referred to "the rear end shaft 10*b* " and the other is referred to "a front end shaft 10*a*").

Also, on an outer side of the housing box 2', there is provided a helical torsion spring 24, one end of which is rotatably attached to a projection 23 formed on the curved inner side of the primary cam groove 22*a*, and the other end of which is rotatably attached to a collar 12, described later, provided at the rear end shaft 10*b* of the lid 1'. A winding portion 24*a* is positioned on the curved inner side of the primary cam groove 22*a*.

In the present embodiment, in the horizontal position of the lid 1', the front end shaft 10*a* provided at the lid 1' is positioned at an upper end of the primary cam groove 22*a*; the rear end shaft 10*b* is positioned at an upper end of the secondary cam groove 22*b*; and a space between both ends of the helical torsion spring 24, i.e. a space between the projection 23 and the rear end shaft 10*b*, is made widest at the horizontal position of the lid 1' (refer to FIGS. 2 and 3).

In the upright position of the lid 1', the rear end shaft 10*b* provided at the lid 1' is positioned at the lower end of the primary cam groove 22*a*; the front end shaft 10*a* is located at a slightly lower position than a communicating position between the primary cam groove 22*a* and the secondary cam groove 22*b*; and the space between both ends of the torsion spring 24 is made widest at the upright position of the lid 1' (refer to FIGS. 6 and 7). When the lid 1' is positioned between the horizontal position and the upright position thereof, the space between both ends of the spring 24 is made narrow (refer to FIGS. 4 and 5).

Thus, in the present embodiment, at the horizontal and upright positions, with the action of the spring 24, a movement of the lid 1' toward the horizontal or upright position is not caused unless a pressing operation is applied to the lid 1'. Also, between such two positions, since it is possible to promote the movement of the lid 1' toward the horizontal position or the upright position with the action of the spring 24 only by applying a slight force to the lid 1' in the horizontal or upright position, the lid 1' can be quickly moved in a direction to which the force is applied. Also, as the lid 1' is moved from the upright position to the horizontal position, the rear end shaft 10*b* is urged to enter into the secondary cam groove 22*b* from the primary cam groove 22 with the action of the spring 24, and the lid 1' is moved to lift its rear end side upward with respect to the front end shaft 10*a* from a position where the rear end shaft 10*b* enters the secondary cam groove 22*b* (refer to FIG. 4).

In the embodiment, the front end shaft 10*a* and the rear end shaft 10*b* are provided with collars 12 to rotate around the shafts 10 and slidably contact the groove walls 22*d* of the cam groove 22. More specifically, in the present embodiment, each shaft 10 is inserted into the cylindrical collar 12 having an inner diameter slightly larger than an outer diameter of the shaft 10, so that the collar 12 is provided on the shaft 10 to be rotatable therearound. Also, the collar 12 is provided on the shaft 10 so that the collar 12 enters the cam groove 22, and also, an outer diameter of the collar 12 is formed to be slightly smaller than a space between the groove walls 22*d* of the cam groove 22, i.e. a width of the cam groove 22. Thus, an outer peripheral portion of the collar 12 slidably contacts the groove walls 22*d* of the cam groove 22 as the lid 1' moves, to thereby rotate around the shaft 10.

As a result, in the present embodiment, as the lid 1' is operated, the lid 1' can be regularly moved by allowing the cam groove 22 to guide the shafts 10 through the collars 12, and also, resistance generated by guiding the shafts 10 along the cam groove 22 through rotation of the collars 12 slidably contacting the groove walls 22*d* of the cam groove 22 can be reduced to thereby smoothly move the lid 1'.

As shown in FIG. 9, the collar 12 may be formed as a simple cylindrical member. However, in the aforementioned embodiment, a flange 12*a* to be caught by a groove edge portion on one side of the cam groove 22 is formed on an outer periphery of the collar 12. In the present embodiment, the flange 12*a* is formed in a disc shape and located at a substantially middle portion in an axial direction of the cylindrical collar 12. Also, the flange 12*a* is caught by groove edge portions 22*e* of the cam groove 22 located outside the housing box 2'.

As a result, in the present embodiment, the collar 12 can be stably positioned in the cam groove 22.

As shown in FIG. 10, it may be structured such that a circular projection 10*c* is provided on an outer periphery of the shaft 10 in a direction surrounding an axis of the shaft 10, and also, there is provided a circular hollow or dent portion 12*b* on an inner periphery of the collar 12 to allow the circular projection 10*c* of the shaft 10 to fit thereinto such that the collar 12 can be rotated with respect to the shaft 10. As the shaft 10 is inserted into the collar 12, the collar 12 is elastically widened, so that the circular projection 10*c* is fitted into the circular dent portion 12*b* to thereby stably position the collar 12 in the cam groove 22.

Also, as shown in FIG. 11, the whole flange 12*a* of the collar 12 may be caught by the groove edge portions 22*e* of the cam groove 22. However, in the aforementioned embodiment, protruded portion 25 is formed to surround the groove edges of the cam groove 22, and also, the flange 12*a* of the collar 12 contacts the projecting end of the protruded portion 25. In the present embodiment, the protruded portion 25 is formed over the whole periphery of the cam groove 22 to surround the groove edges of the cam groove 22 provided on the outside of the housing box 2'. Also, the protruded portion 25 has such a width to allow the projecting end to contact a base side of the flange 12*a* of the collar 12.

As a result, in the present embodiment, the flange 12*a* of the collar 12 does not contact the whole outer surface of the cam groove 22 at the groove edge portion 22*e* of the cam groove 22, so that a slidable contact resistance relative to the housing box 2' as the fixed member 2 where the collar 12 and the cam groove 22 are formed, is not extremely increased.

Also, in the aforementioned embodiment, the collar 12 and the portions where the collar 12 slidably contacts the cam groove 22 are formed of a plastic material. In this embodiment, the housing box 2' is formed of the plastic material as a whole.

In case two members made of a plastic material are used together, even if a special surface treatment is not applied to the sliding contact surfaces, a frictional resistance caused by the sliding contact of the members made of the plastic material becomes lower than that of a member made of a plastic material and a member made of a metal material. As a result, in the present embodiment, even if the collar 12 slidably contacting the groove walls 22*d* of the cam groove 22 is not rotated around the shaft 10 by the sliding contact, the outer peripheral surface of the collar 12 is likely to slide along the groove walls 22*d*, so that the lid 1' can be always smoothly moved.

Also, in the aforementioned example, each of the shafts 10 includes the disc shape head portion 10*d* on one end side thereof, and also, in the projection portion 11 of the lid 1', there are provided inserting holes 11*a* for the shafts 10 in a left-and-right direction of the lid 1' with a size which does not allow the head portion 10*d* of the shaft 10 to pass therethrough. Also, each shaft 10 is inserted into the cam groove 22 through the inserting hole 11*a* from the other end side thereof to a position where the head portion 10*d* is caught around the inserting hole 11*a*. Further, a prevention member for preventing the shaft 10 from slipping out of the cam groove 22 is attached to the other end side of the shaft 10.

In the present embodiment, the preventing member is rotatably attached to a shaft projection 27 formed in a curved inner side of the cam groove 22 on an outer side of the housing box 2', and also, the preventing member is formed as a rotating plate 26 including an attaching hole 26*a* for attaching to the end side of the front end shaft 10*a*, and a groove hole 26*c* for slidably receiving the end side of the rear end shaft 10*b*.

Specifically, each shaft 10 is provided with a circular groove 10*e* surrounding the shaft 10 on the other end side thereof, and as the other end side of the front end shaft 10a is inserted into the attaching hole 26*a* of the rotating plate 26, an elastic projection 26*b* provided inside the attaching hole 26*a* is once subjected to an elastic deformation and is then elastically returned to be inserted into the circular groove 10*e* of the front end shaft 10*a*. Also, projections 26*d* to be fitted into the circular groove 10*e* of the rear end shaft 10*b* are provided on a hole wall of the groove hole 26*c* of the rotating plate 26 along an extending direction of the groove hole 26*c*, so that the projection 26*d* is fitted into the circular groove 10*e* from an open end 26*e* of the groove hole 26*c* opened outward at an edge of the rotating plate 26 and the other end side of the rear end shaft 10*b* is attached so as to be slidably moved along the groove hole 26*c*.

As a result, in the present embodiment, the shafts 10 provided with the collars 12 are inserted through the inserting holes 11*a* of the lid 1', so that the collars 12 are positioned in the cam groove 22, and then, by attaching the rotating plate 26 to the other end side of the shafts 10, the lid 1' can be easily attached to the housing box 2' in a state where the lid 1' is regularly moved by the cam groove 22.

Incidentally, in the aforementioned example, as the lid 1' moves between its horizontal position and its upright position, the rotating plate 26 is also rotated around the shaft projection 27. Also, the groove hole 26*c* provided at the rotating plate 26 is formed to allow the rear end shaft 10*b* to move from the primary cam groove 22*a* to the secondary cam groove 22*b*.

According to the guiding structure for the moving member of the present invention, without applying a lubricant to the shaft provided to one of the fixed member and the moving member and guided by the cam groove formed on the other of the fixed member and the moving member, the shaft can be guided with less frictional resistance with respect to the cam groove through the collar rotatably provided on the shaft to thereby smoothly move the moving member.

While the invention has been explained with reference to the specific embodiments of the invention, the explanation is illustrative and the invention is limited only by the appended claims.

What is claimed is:

1. A guiding structure comprising:

a fixed member and a moving member slidably attached to the fixed member, a cam groove provided in the fixed member and having groove walls and groove edges, a shaft attached to the moving member and inserted into the cam groove, and a collar provided on the shaft to be rotatable around the shaft while slidably contacting the groove walls of the cam groove, said collar having a flange formed on an outer periphery thereof to project radially outwardly from the outer periphery and to contact one of the groove edges of the cam groove.

2. A guiding structure as claimed in claim 1, further comprising a protruded portion with a projecting end formed on at least one of the groove edges of the cam groove, said flange of the collar contacting the projecting end of the protruded portion.

3. A guiding structure as claimed in claim 1, wherein said collar and at least a portion of the cam groove where the collar slidably contacts are made of a plastic material.

4. A guiding structure as claimed in claim 1, wherein said fixed member is a housing box having an opening, and said moving member is a lid movable from a position for closing the opening of the housing box to a position for opening the opening.

5. A guiding structure as claimed in claim 4, wherein said cam groove is formed on a side wall of the housing box, and the shaft has a head portion at one end so that the shaft is inserted into the cam groove from the other end thereof through a shaft inserting hole provided at the lid to a position where the head portion is caught by the shaft inserting hole.

6. A guiding structure as claimed in claim 5, further comprising a preventing member fixed to the other end of the shaft for preventing the shaft from being extracted from the cam groove.

7. A guiding structure as claimed in claim 5, wherein said shaft includes first and second shafts attached to the lid and inserted into the cam groove, said cam groove having a primary cam groove in an arc shape and a secondary cam groove extending upwardly from a middle portion of the primary cam groove so that in the closing position, the first shaft is located at an upper end of the primary cam groove and the second shaft is located at an upper end of the secondary cam groove, and in the opening position, the first and second shafts are located in the primary cam groove.

8. A guiding structure as claimed in claim 7, further comprising a preventing member rotatably attached to the housing box, said preventing member having a first hole for engaging an end of the first shaft, and a groove for slidably engaging an end of the second shaft.

9. A guiding structure as claimed in claim 1, wherein said collar includes a small diameter portion located in the cam groove, and a large diameter portion extending outwardly from the small diameter portion, said flange being formed at a boundary between the large and small diameter portions.

10. A guiding structure as claimed in claim 7, wherein the cam groove is formed on each side wall of the housing, and the first and second shafts are located in each cam groove of the housing.

11. A guiding structure comprising:

a fixed member, and a moving member slidably attached to the fixed member, a cam groove provided in the fixed member and having groove walls, a shaft attached to the moving member and inserted into the cam groove, said shaft having an annular projection formed on an outer periphery thereof to surround the same, and a cylindrical collar provided on the shaft to be rotatable around the shaft while slidably contacting the groove walls of the cam groove, said collar having a hole for allowing the shaft to pass therethrough, an annular dent portion formed on an inner periphery of the hole for receiving the annular projection therein so that the collar is rotatably held around the shaft, and a length greater than a width of the cam groove to project outwardly from the cam groove.

* * * * *